US006247623B1

(12) United States Patent
Walters

(10) Patent No.: US 6,247,623 B1
(45) Date of Patent: Jun. 19, 2001

(54) SAFETY GUN HOLSTER

(76) Inventor: Joseph N. Walters, 874 NE. 80th, Miami, FL (US) 33138

( * ) Notice: Subject to any disclaimer, the term of this patent is extended or adjusted under 35 U.S.C. 154(b) by 0 days.

(21) Appl. No.: 09/455,428

(22) Filed: Dec. 6, 1999

(51) Int. Cl.[7] ..... F41C 33/02

(52) U.S. Cl. ..... 224/255; 224/669; 224/677; 224/911

(58) Field of Search ..... 224/255, 666, 224/669, 677, 911

(56) References Cited

U.S. PATENT DOCUMENTS

| | | | | |
|---|---|---|---|---|
| 1,166,781 | * | 1/1916 | Parrish | 224/255 |
| 1,768,177 | * | 6/1930 | Wanee | 224/255 |
| 3,642,184 | * | 2/1972 | Hendricks | 224/255 |
| 3,707,250 | * | 12/1972 | Esposito | 224/911 |
| 3,796,358 | * | 3/1974 | Grubb | 224/911 |
| 4,420,104 | * | 12/1983 | Dilenno | 224/250 |
| 4,836,425 | * | 6/1989 | McClellan | 224/163 |
| 4,925,075 | | 5/1990 | Rogers . | |
| 5,163,591 | * | 11/1992 | Leiserson et al. | 224/148 |
| 5,358,160 | * | 10/1994 | Bianchi | 224/244 |
| 5,395,021 | | 3/1995 | Brown . | |
| 5,441,187 | * | 8/1995 | Mixson | 224/243 |
| 5,573,157 | | 11/1996 | Mauriello et al. . | |
| 5,611,471 | | 3/1997 | French . | |
| 5,687,891 | * | 11/1997 | Beletsky | 224/243 |
| 5,806,739 | * | 9/1998 | Wood | 224/555 |
| 5,810,222 | | 9/1998 | Shoemaker . | |
| 5,820,003 | * | 10/1998 | Nichols | 224/575 |
| 5,991,925 | * | 11/1999 | Wu | 224/911 |

* cited by examiner

*Primary Examiner*—Stephen P. Garbe
(74) *Attorney, Agent, or Firm*—Robert Ryan Morishita Anderson & Morishita

(57) ABSTRACT

The present invention is that of a new and improved device capable of securing a firearm, with an incorporated trigger guard designed specifically to prevent accidental discharge of the weapon. The device also has an incorporated belt clip allowing the device to be freely attached to a belt or a pair of pants worn by a user. The device also has an incorporated gun barrel holder, allowing an additional securing means for a weapon that is placed within the present invention. A cloth cover on the gun barrel holder will insure that the barrel of any weapon placed into the present invention will remain clean. The device also includes a rear mounted strap allowing any weapon placed within the device to be securely positioned in a non-flexible position.

2 Claims, 3 Drawing Sheets

SAFETY GUN HOLSTER

BACKGROUND OF THE INVENTION

The present invention is that of an apparatus designed to safely secure a firearm such that accidental discharge of the firearm will be prevented.

DESCRIPTION OF THE PRIOR ART

There are a wide variety of devices that secure weapons and attach to a person or other object in the prior art. One example is U.S. Pat. No. 5,810,222, issued to Shoemaker, which discloses a handgun holster that has detent features, preferably confronting detent jaws mounted on inside surfaces of the holster adapted to be displaced by the trigger guard of a handgun upon the insertion of the handgun.

U.S. Pat. No. 5,611,471, issued to French, discloses a gun holster comprising a main frame, two flattened "C" shaped pieces or the like for mounting the holster to an object, a trigger guard support arm or the like to prevent lateral movement, and a gun support such as a barrel support arm.

U.S. Pat. No. 5,573,157, issued to Mauriello et al., discloses a security system for use in a pistol holder for the selectable engagement and disengagement of the trigger guard of a pistol or gun.

U.S. Pat. No. 5,395,021, issued to Brow, discloses a handgun holster and retention block assembly that holds the handgun in a retained position by a spring bias trigger guard latch that is located under the sheath material of the holster to conceal it from view and reduce the possibility of unauthorized release.

U.S. Pat. No. 4,925,075, issued to Rogers, discloses a handgun holster having a restraining device inside the holster for retaining the handgun in a holster and inhibiting inadvertent removal from the holster, the restraining device employing a spring biased catch for engaging the trigger guard with a selectively adjustable member to provide increased or decreased restraining force on the trigger guard.

SUMMARY OF THE INVENTION

The present invention is that of a new and improved device capable of securing a firearm, with an incorporated trigger guard designed specifically to prevent accidental discharge of the weapon. The device also has an incorporated belt clip allowing the device to be freely attached to a belt or a pair of pants worn by a user. The device also has an incorporated gun barrel holder, allowing an additional securing means for a weapon that is placed within the present invention. A cloth cover on the gun barrel holder will insure that the barrel of any weapon placed into the present invention will remain clean. The device also includes a rear mounted strap allowing any weapon placed within the device to be securely positioned in a non-flexible position. The frame of the device is preferably leather, with the various leather pieces held together by stitching.

It is therefore an object of the present invention to provide a new and improved weapon holster.

It is another object of the present invention to provide a new and improved weapon holster that will clip to a belt or set of pants.

It is yet another object of the present invention to provide a new and improved weapon holster that would securely hold a firearm in place while also preventing accidental discharge.

It is still another object of the present invention to provide a new and improved weapon holster that is easily and inefficiently manufactured.

Other objects, features and advantages of the present invention will become more readily apparent from the following detailed description of the preferred embodiment when considered with tile attached drawings and appended claims.

DESCRIPTION OF THE PREFERRED EMBODIMENT

Figure 1:
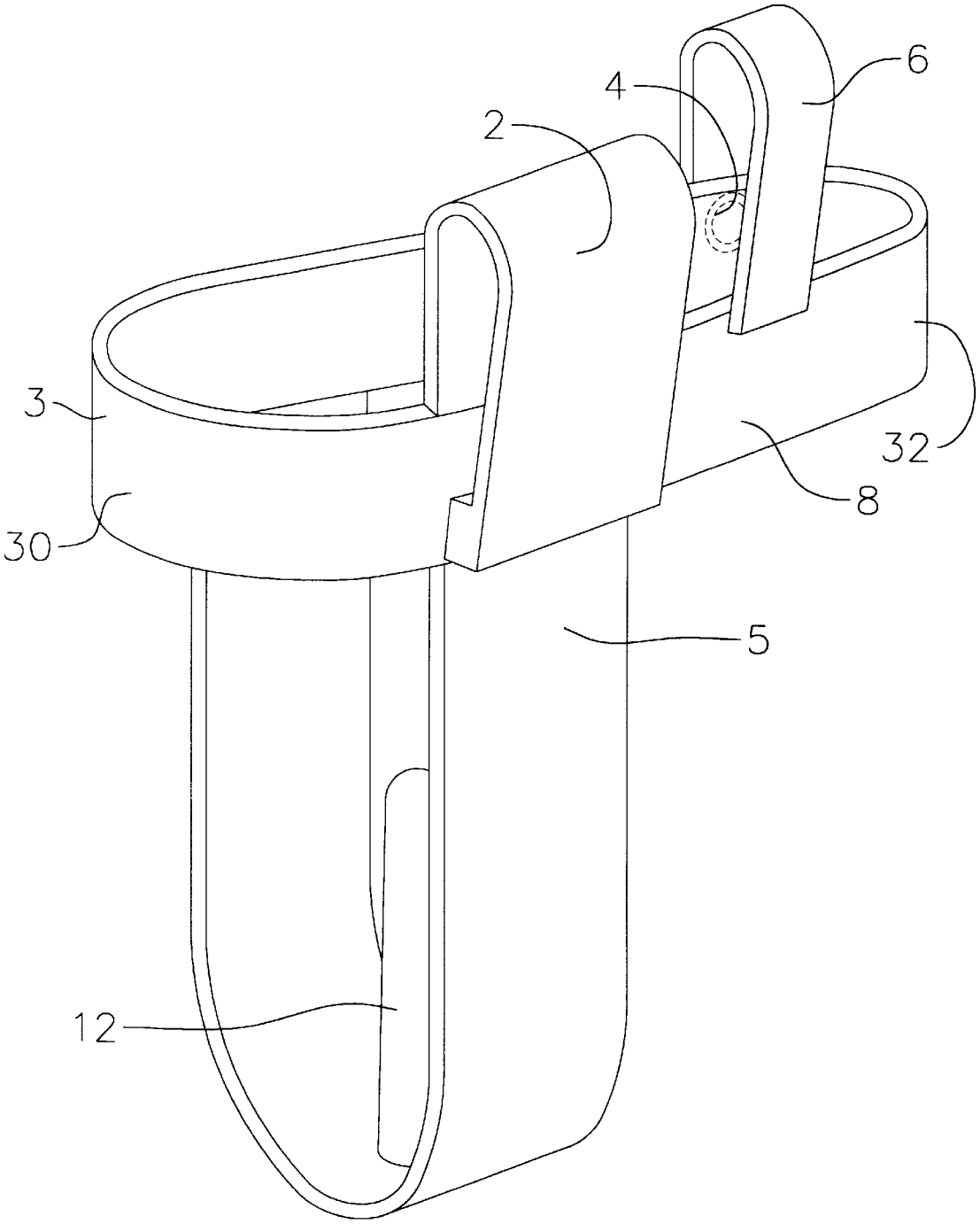
FIG. 1 is a perspective view of the present invention.

Referring now to FIG. 1, holster 1 is shown with associated parts upper strap 3, trigger guard 8, supporting strap 5, belt clip 2, gun barrel holder 12, safety strap 6, and snap 4.

Upper strap 3, supporting strap 5, trigger guard 8, and safety strap 6 are preferably fabricated from leather. Upper strap 3 is a continuous loop of leather formed from a leather strap that has been sewn together. Upper strap 3 has a continuous outer surface and a continuous inner surface, and has two continuous edges, an upper edge and a lower edge. Upper strap 3 is preferably shaped together in the shape of an oval, therefore forming two so-called ""ends ""—end loops—, a first end—loop 30—and a second end—loop 32—, with the second end—loop 32—being slightly tapered "toward the back", with the "tapered" second end—loop 32—also serving as a handle support for a weapon placed in the present invention. —The second end loop 32 would serve as a handle support by allowing the handle of a weapon placed within holster 1 to rest against the continuous inner surface of upper strap 3 near second end loop 32. Trigger guard 8 of upper strap 3 serves as a trigger guard of a weapon placed within holster 1 solely by its position. A weapon placed within holster 1 would have the trigger of that weapon located behind the trigger guard 8 portion of upper strap 3, and hence, upper strap 3 would protect the user by acting to prevent physical contact with the trigger of a weapon while it is positioned within holster 1.

Attached to upper strap 3 is supporting strap 5. Supporting strap 5 is a strap that has two ends, a first end and a second end Both the first end and the second end of supporting strap 5 are attached to the continuous inner surface of upper strap 3, preferably by stitching. Supporting strap 5 is preferably attached to upper strap 3 near the first end loop 30 of upper strap 3. Supporting strap 5 also includes a bottom end which is formed by the action of supporting strap 5 looping around while running from the attachment of said first end and the attachment of said second end. Supporting strap 5 has two continuous surfaces, an inner surface and an outer surface.

Holster 1 also includes belt clip 2, which is fixedly attached to the upper edge of upper strap 3 near the first end loop 30 of upper strap 3. Belt clip 2 would preferably be made of a flexible plastic and would permit holster 1 to be mounted onto a person by attaching holster 1 to a belt or pant edge of a person.

Safety strap 6 would be a leather safety strap located near the second end loop 32 of upper strap 3. Safety strap 6 would have two ends, a first end and a second end, with the first end being fixedly mounted by stitching means to the continuous outer surface of upper strap 3. The second end of safety strap 6 includes incorporated snap 4, which allows safety strap 6 to be removably attached to the continuous outer surface of upper strap 3. Once safety strap 6 is properly attached, safety strap 6 will loop over and above the second end loop 32 of upper strap 3 and serve as a restraining mechanism for a gun that has been placed within holster 1.

Gun barrel holder 12 would be a small rod removably attached to the lowest point on the inner surface of supporting strap 5. Gun barrel holder 12 would serve as a gun barrel holder, permitting the barrel of a gun to slide over gun barrel holder 12 when a gun would be placed within holster 1.

Figure 2:
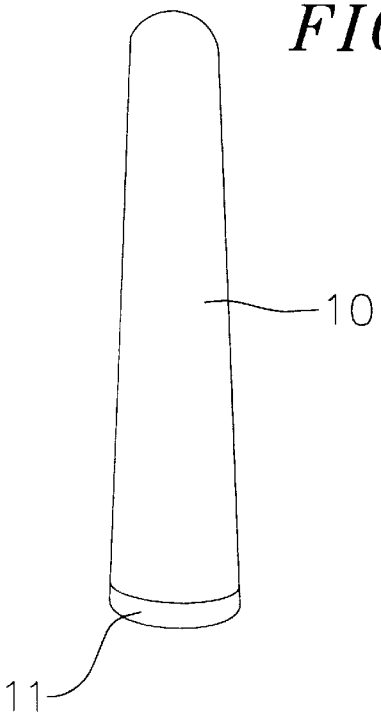
FIG. 2 shows a side view of the cloth cover and elastic band of the present invention.

FIG. 2 shows cloth cover 10 and elastic band 11, which is incorporated onto cloth cover 10. Cloth cover 10 is an optional addition to the present invention and when placed over and on top of gun barrel holder 12, would clean the inside of the barrel of any gun placed onto holster 1. Elastic band 11 would insure that cloth cover 10 would remain in place on gun barrel holder 12 until a user would take cloth cover 10 off.

Figure 3:
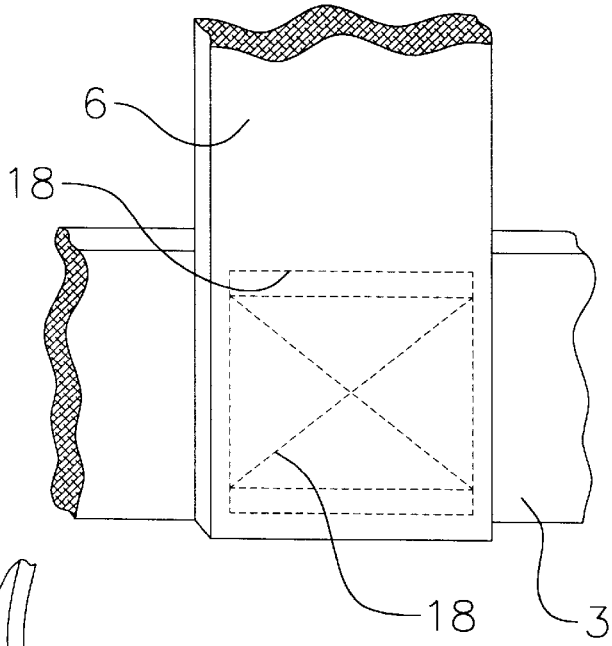
FIG. 3 shows a close up side view demonstrating how the safety strap is attached to the upper strap.

FIG. 3 shows a closeup side view demonstrating how safety strap 6 is attached to upper strap 3. Stitching 18 serves to attach safety strap 6 to upper strap 3, and need not take the specific shape or orientation shown in FIG. 3. Stitching is also used to attach other leather parts to each other in the present invention.

Figure 4:
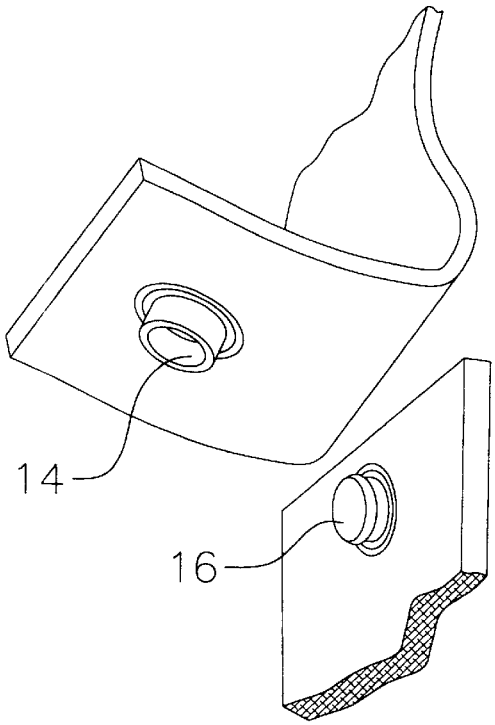
FIG. 4 shows a detailed perspective view of the breakdown of the snap of the present invention.

FIG. 4 shows a detailed breakdown of snap 4, which is composed of female snap component 14 and male snap component 16. Female snap component 14 is fixedly attached to the continuous outer surface of upper strap 3, while male strap component 16 is fixedly attached to an inner surface of safety strap 6. After a weapon has been placed within holster 1, a user can push male snap component 16 into female snap component 14, at which time, they will removably connect to each other.

Figure 5:
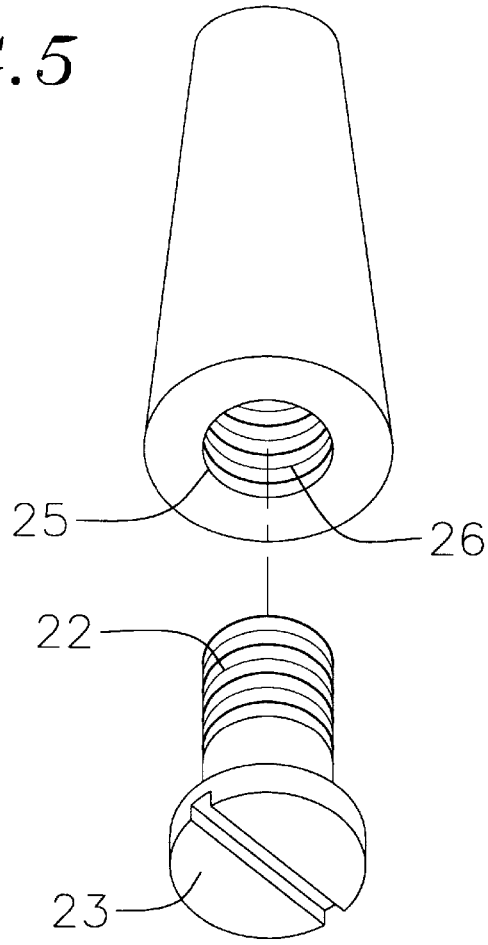
FIG. 5 shows a detailed perspective breakdown of gun barrel holder 12 and its respective parts.

FIG. 5 shows the internal mechanisms of gun barrel holder 12 that allow gun barrel holder 12 to be attached to supporting strap 5. Supporting strap 5 includes attachment screw 23 which is attached to the lowest point of the inner surface of supporting strap 5, and attachment screw 23 has male threads 22 attached to an extended end of attachment screw 23. Gun barrel holder 12 has internally located female threads 26 within hole 25, which is located on the bottom surface of gun barrel holder 12. Hole 25 is of a specific width that attachment screw 23 can be secured into hole 25 and securely connected with gun barrel holder 12, thereby effectively mounting gun barrel holder 12 onto supporting strap 5.

Figure 6:
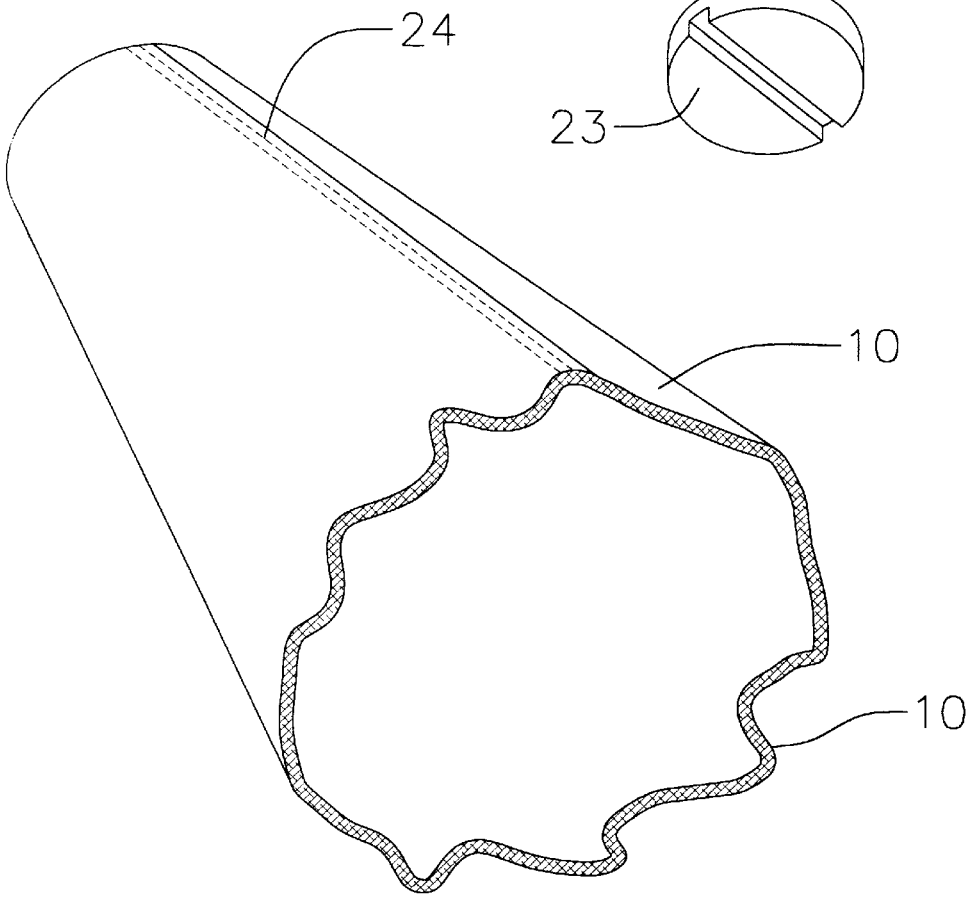
FIG. 6 shows a closeup side view of cloth cover 10 with the attached stitching.

FIG. 6 shows a closeup view of cloth cover 10, with attached stitching 24.

What I claim as my invention is:

1. A gun holster, said gun holster comprising:

a. an upper strap, said upper strap being shaped in a continuous loop, said upper strap including two continuous surfaces, a continuous outer surface and a continuous inner surface, said upper strap including two continuous edges, an upper edge and a lower edge, said upper strap being preferably shaped in the shape of an oval, said oval including two ends, a first end and a second end, said second end of said oval of said upper strap being slightly tapered, b. a supporting strap, said supporting strap including two continuous surfaces, an inner surface and an outer surface, said supporting strap including two ends, a first end and a second end, said first end of said supporting strap being attached to the continuous inner surface of said upper strap near said first end loop of said upper strap, said second end of said supporting strap fixedly attached to the continuous inner surface of said upper strap near said first end loop of said upper strap, said supporting strap being located beneath said upper strap, said supporting strap also including a bottom end, c. a belt clip, said belt clip fixedly attached to the upper edge of said upper strap near the first end loop of said upper strap, d. a safety strap, said safety strap including two surfaces, an inner surface and an outer surface, said safety strap including two ends, a first end and a second end, with the first end of said safety strap being fixedly mounted to the continuous outer surface of said upper strap near the second end loop of said upper strap, said second end of said safety strap being capable of being removably attached to the continuous outer surface of said upper strap, and e. a gun barrel holder, said gun barrel holder being a small rod removably attached to the lowest point on the inner surface of said supporting strap.

2. A gun holster according to claim 1, wherein said gun holster further comprises a cloth cover, said cloth cover including an incorporated elastic band, said cloth cover being used to cover said gun barrel holder, said cloth cover cleaning the inside of any barrel of any gun placed into said gun holster, and said elastic band of said cloth cover insuring that said cloth cover will remain in place on said gun barrel holder until removed.

* * * * *